United States Patent [19]

Coffta et al.

[11] 4,151,384

[45] Apr. 24, 1979

[54] MULTI-PHASE SWITCH WITH VARIABLE POLE SPACING

[75] Inventors: Joseph A. Coffta, Getzville; William P. Heim, Cheektowaga; Thomas A. Wilsdon, Alden; Glenn A. Barlis, Fairport, all of N.Y.

[73] Assignee: Westinghouse Electric Corp., Pittsburgh, Pa.

[21] Appl. No.: 769,599

[22] Filed: Feb. 17, 1977

[51] Int. Cl.[2] ..... H01H 3/00; H01H 1/34

[52] U.S. Cl. ..... 200/153 R; 200/249; 337/7

[58] Field of Search ..... 200/153 R, 249; 337/7

[56] References Cited

U.S. PATENT DOCUMENTS

| | | | |
|---|---|---|---|
| 3,198,924 | 8/1965 | Brumfield et al. | 200/249 |
| 3,264,432 | 8/1966 | Hodgson et al. | 337/7 |
| 3,268,702 | 8/1966 | Gryetko | 200/249 X |

*Primary Examiner*—William D. Martin, Jr.
*Attorney, Agent, or Firm*—L. P. Johns

[57] ABSTRACT

A multi-pole switch characterized by spaced sets of stationary and movable contacts, mounting means for the movable contacts comprising a common contact operating shaft rotatable between open and closed positions of the contacts, the mounting means for each movable contact comprising a bracket operatively mounted on the operating shaft and having releasable means for retaining one contact at one position spaced from an adjacent contact, the bracket including means for releasably retaining one movable contact in one position laterally spaced from an adjacent contact, the mounting means also comprising a unitary insulating base mounted on the shaft and having spaced mounting stations for the movable contacts, and mounting means comprising interfitting releasable members for adjusting the lateral spacing between adjacent movable contacts.

7 Claims, 6 Drawing Figures

MULTI-PHASE SWITCH WITH VARIABLE POLE SPACING

BACKGROUND OF THE INVENTION

1. Field of the Invention

This invention relates to a multi-phase switch having variable pole spacing.

2. Description of the Prior Art

Multi-phase switches, such as three-phase motor starters, are rated at 2500 volts and 5000 volts for 200, 400, and 700 amperes, which means are established in accordance with industrial control standards of the National Electrical Manufacturers Association. Heretofore the motor starters have employed three basic frames, each using one of three shaft assemblies with two different pole spacings. The disadavantages of the foregoing have been primarily economical; namely, the additional costs of providing three shaft assemblies with two different pole spacings.

SUMMARY OF THE INVENTION

It has been found in accordance with this invention that the foregoing disadvantages may be overcome by providing a multi-phase switch comprising separable contact means for opening and closing a circuit through each phase, means for operating the contact means and comprising a contact-operating shaft operatively connected to the contact means, means for rotating the operating shaft, the separable contact means comprising a movable contact for each phase, mounting means for each movable contact and comprising a bracket operatively mounted on the operating shaft, the bracket having releasable means for retaining one movable contact at one position spaced from an adjacent contact, the releasable means being adjustable to permit movement of the movable contact to another position, the mounting means comprising a unitary insulating base on the shaft having spaced mounting positions for and corresponding to the movable contacts and on which the movable contact mounting means are fixedly mounted, each mounting means comprising a support frame on which the movable contact is pivotally mounted, each mounting station also comprising platform means for supporting the support frame, each support frame being a U-shaped member including spaced arms and an interconnecting member, the platform means comprising spaced parts of the unitary base between which the mounting means are disposed and on which the spaced arms are mounted, the interconnecting means including spaced set means, and the mounting means also including a releasable lever engageable with the set means for permitting lateral spacing of one moving contact with respect to an adjacent contact.

The advantage of the multi-phase switch of this invention is that three shaft assemblies have been replaced with one assembly having the two pole spacings obtained by manual adjustments. Further advantages include the reduction and simplification of parts associated with the shaft assembly, whereby production procedures as well as parts inventories are greatly simplified.

DESCRIPTION OF THE PREFERRED EMBODIMENT

Although the device of this invention may be used in various types of switching apparatus, one type to which it is particularly adapted is that shown in U.S. Pat. No. 3,264,432 which is incorporated herein by reference. In that patent, a complete description of the operating parts of switching apparatus employing a fuse as a movable contact is provided, for which reason the description is limited herein to only the essential parts.

Figure 1:
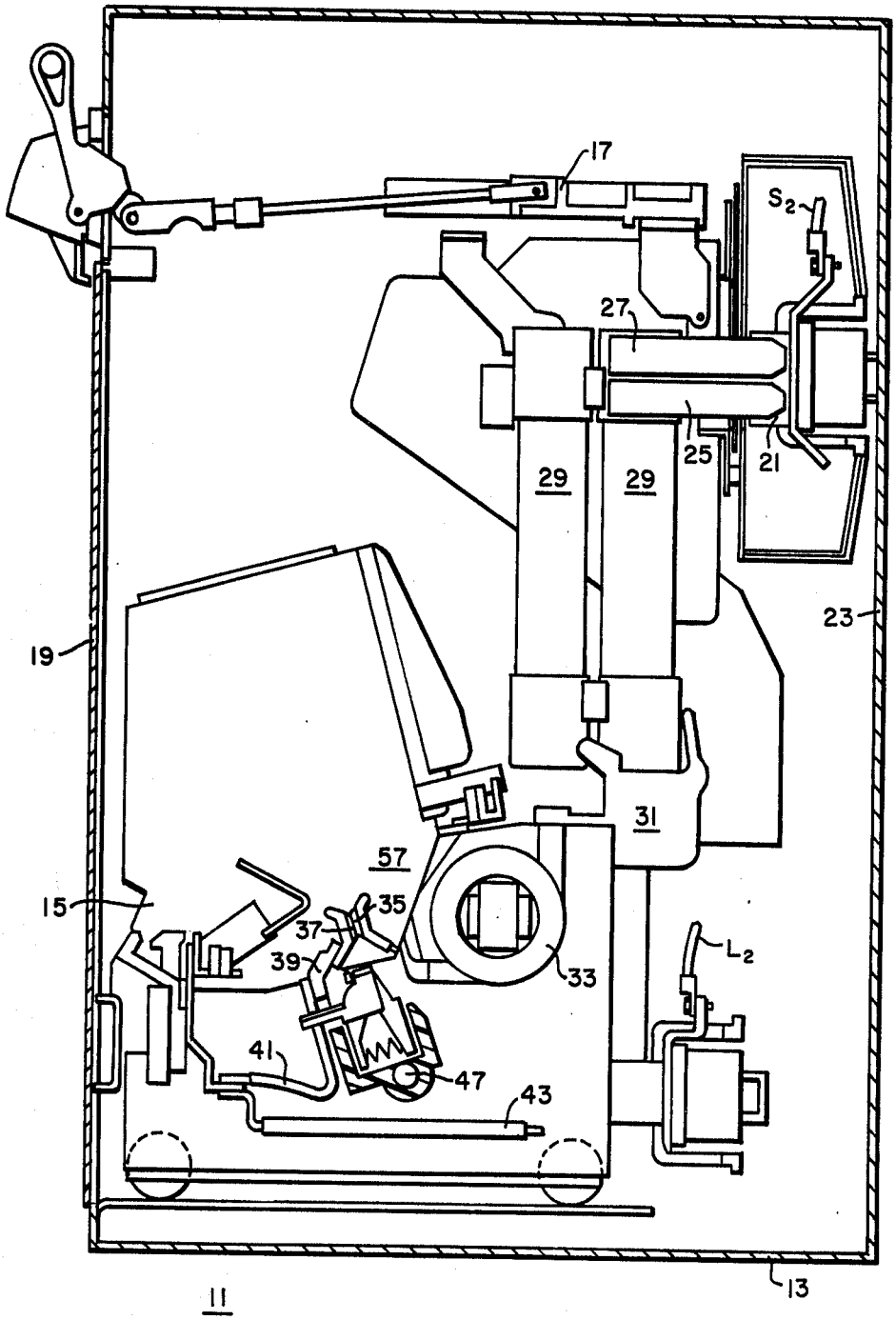
FIG. 1 is a vertical sectional view of a switching apparatus incorporating the features of this invention.

In FIG. 1 a high voltage motor starter apparatus is generally indicated at 11 and it comprises a cabinet 13 in which high voltage modular plug-in assemblies are disposed. The plug-in assemblies comprise a contactor unit 15 and an isolation switch unit 17, each being slidably removable from the cabinet housing to which access is provided by a hinged access door 19.

Since a three-phase example is shown, the main contactor unit 15 has three sets of main contacts and attendant blowout coils and arc chutes, only one of which is shown in FIG. 1. It is understood that all sets of the same are duplicates of one another. The electric circuit through the phase shown in FIG. 1 is conducted from the supply conductor $S_2$ through a terminal stab 21 mounted on a rear panel 23, stab contact 25, fuse clips 27, fuse 29, fuse mount 31, blowout coil 33, stationary contact 25, movable contact 37, contact arm 39, and ultimately through conductors 41, 43 to load lines $L_2$.

A means for supporting and operating the movable contacts 37 is generally indicated at 45 as shown in FIG. 2, 3, 4, and 6. The means 45 comprises a shaft 47, a base 49, and mounting means 51. The shaft 47 is rotatably mounted in a conventional manner on the frame of the motor starter 11. An armature 53 is secured on the shaft in suitable means such as by a bolt 55 and is aligned to be attracted by an electromagnet 57 (FIG. 1) when the latter is energized in response to an abnormal current condition such as a short circuit. Thus when the electromagnet 57 is energized the armature 53 rotates from the position shown in FIG. 4 counterclockwise to a position where the movable contact 37 is in the open position.

Base 49 is a unitary, molded member fixedly mounted on the shaft 47 and comprised of an electrically insulating material such as an epoxy resin. The base 49 includes three spaced mounting stations 59, 61, 63 for the three movable contacts 37. Each station 59, 61, 63 comprises pairs of similar upright supports 65 (FIG. 2) forming platform means 66 on and between which the mounting means 51 are disposed. In addition, the base 49 (FIG. 4) includes a pair of laterally spaced reinforcing portions 67, 79 extending between each corresponding pair of supports 65 and forming therewith a cup-shaped or U-shaped container in which the lower portion of the mounting means 51 is disposed.

Figure 3:
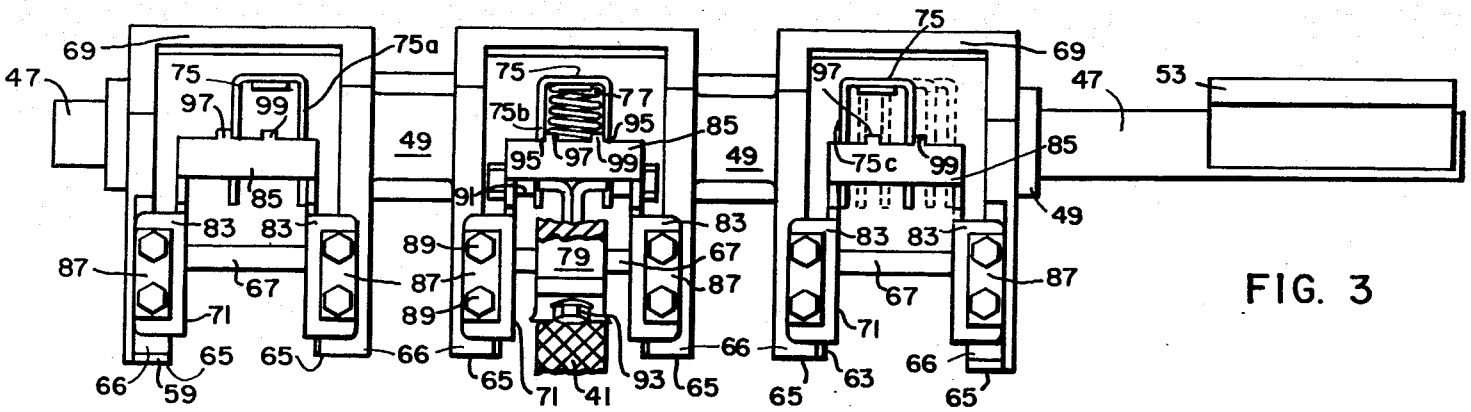
FIG. 3 is a plan view of the assembly of the contact operating shaft.
Figure 2:
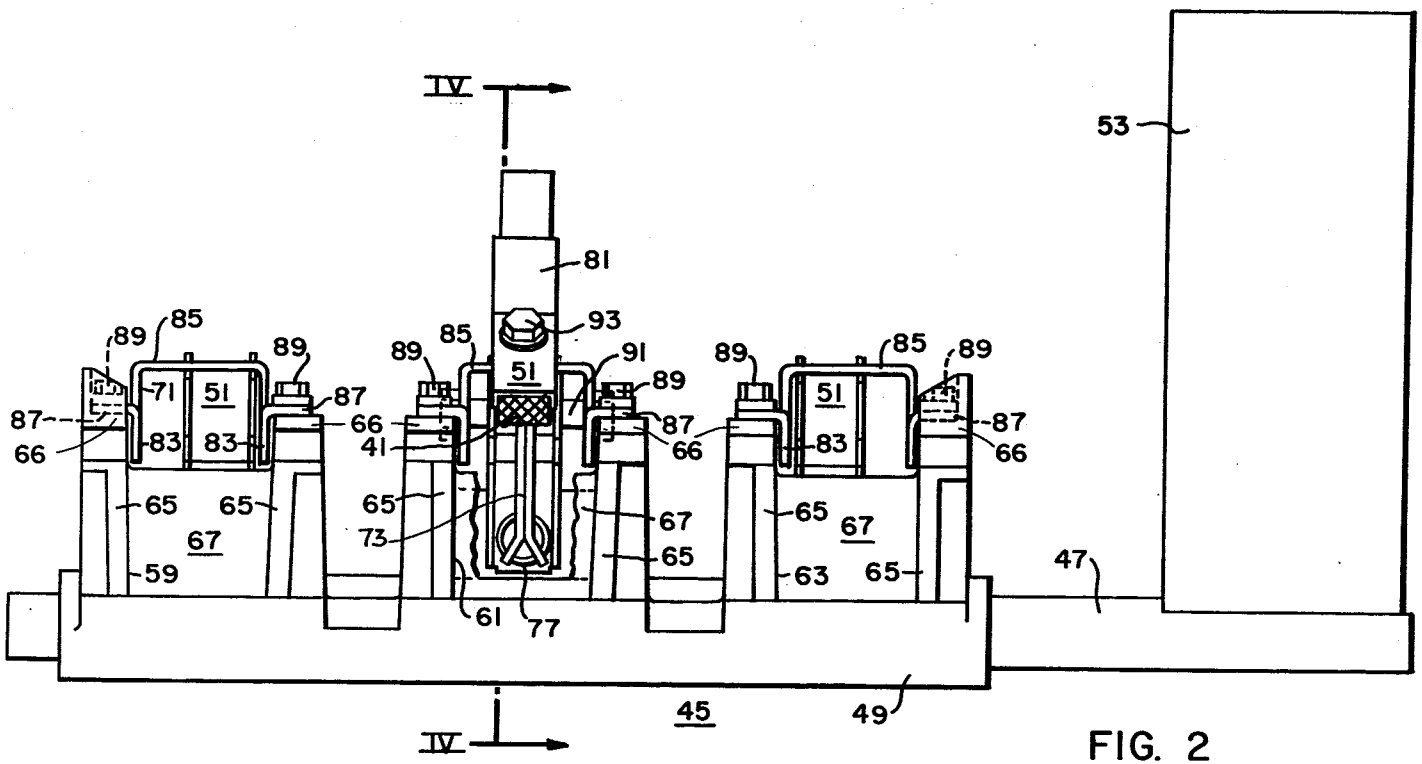
FIG. 2 is an enlarged elevational view of the assembly of the contact-operating shaft.
Figure 6:
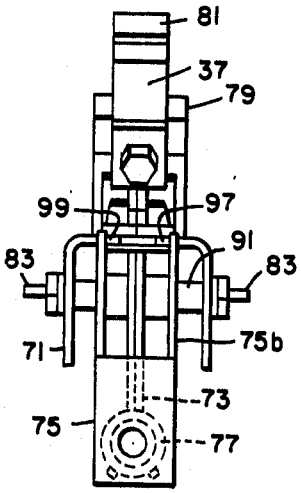
FIG. 6 is an end view of the mounting means taken on the line VI—VI of FIG. 4.
Figure 4:
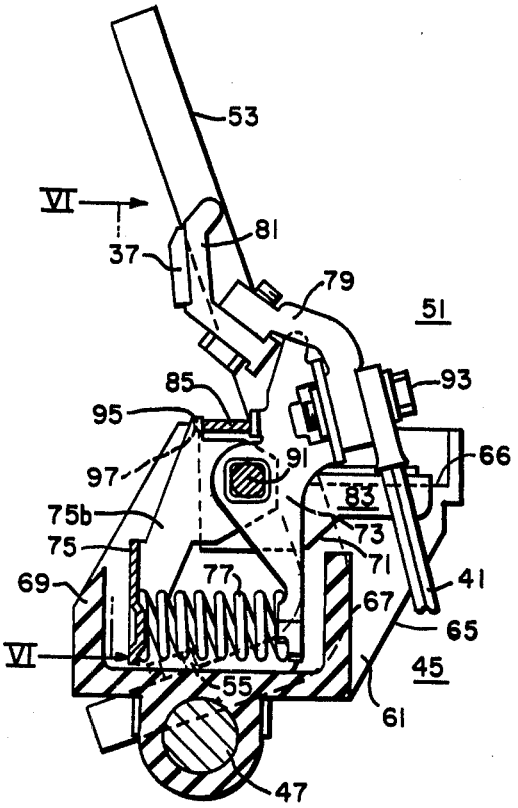
FIG. 4 is a vertical sectional view taken on the line IV—IV of FIG. 2.
Figure 5:
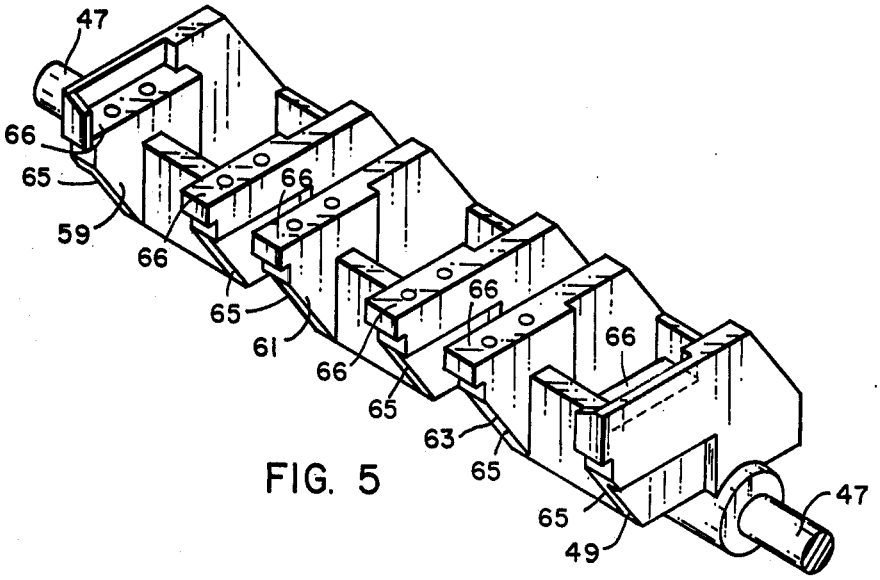
FIG. 5 is an isometric view of the contactoperating shaft with contact mounting means thereon

The mounting means 51 comprises a mounting bracket 71, a pivot arm 73, a spring seat 75, a spring 77, a contact support 79, and a contact holder 81. As shown in FIG. 3, the mounting bracket 71 is a U-shaped member having similar legs 83 and an intermediate member 85. Each leg 83 comprises an out-turned flange 87, which by suitable means such as screws 89, are secured to corresponding pairs of supports 65 (FIG. 3).

The pivot arm 73 is pivotally mounted on a pivot pin 91 which extends between the legs 83 of the mounting bracket 71 (FIG. 3). The upper end of the arm 73 holds the contact support 79 in place by a nut-bolt assembly 93 by which the upper end of the shunt conductor 41 is also held in place. The lower end of the arm 73 is biased in the clockwise direction about the pivot pin 91 by the spring 77. The spring seat 75 is a releasable lever and supports the opposite end of the spring 77 and is likewise pivoted on the pivot pin 91 with the upper end of the spring seat 75 being biased by the spring 77 against the intermediate member 85 at 95 of the mounting bracket 71.

In accordance with this invention, the intermediate member 85 (FIG. 3) is provided with set tabs comprising a pair of spaced projections or ears 97, 99. As shown in FIG. 3, the three spring seats 75 are disposed in different positions with respect to the projections 97, 99. For example, the spring seat 75*a*, being a U-shaped member, is disposed on the right of both projections 97, 99 with the one leg of the U-shaped seat 75*a* being adjacent the projection 97. The intermediately disposed spring seat 75*b* straddles both of the projections 97, 99 with opposite sides of the spring seat contacting the intermediate member 85 at 95 on opposite sides of the projections. On the other hand, the spring seat 75*c* is disposed to the left of the projections 97, 99 with the right portion of the spring seat being adjacent to the projection 99 as shown. Each pair of pivot arms 73 and spring seat 75 are mounted on corresponding pivot pins 91 so that each movable contact 37 is slidable to and from an adjacent movable contact where it is retained in position by the projections 97, 99 after being so maneuvered.

Accordingly, the three pole switch is readily adjusted to provide different spaces between the several contacts 37 in accordance with the different ratings such as 200, 400, and 700 amperes of the multi-phase switches or motor starters.

What is claimed is:

1. A multi-phase switch comprising separable contact means for opening and closing a circuit through each phase, means for operating the contact means and comprising a contact-operating shaft operatively connected to the contact means, means for rotating the operating shaft, the separable contact means comprising a movable contact for each phase, mounting means for each movable contact and comprising a mounting bracket mounted on the operating shaft at a fixed lateral distance from an adjacent mounting bracket, the mounting means comprising a pivot arm pivotable into and out of contact with the mounting bracket and movable laterally on the bracket within spaced lateral limits in a plane normal to the plane of pivot movement, the mounting bracket and the pivot arm having laterally spaced engaging surface means for retaining the movable contact at any desired lateral spacing with respect to an adjacent contact, whereby the movable contacts of adjacent phases are shiftable between variously spaced positions dependent upon the voltage rating of the switch.

2. The switch of claim 1 in which the mounting means comprises a unitary base mounted on the shaft and comprised of electrically insulating material, and the unitary base having spaced mounting stations for and corresponding to the movable contacts and on which the movable contact mounting means are fixedly mounted.

3. The switch of claim 2 in which the unitary base is a molded plastic member.

4. The switch of claim 3 in which and each mounting station comprises platform means for supporting the mounting bracket.

5. The switch of claim 4 in which each mounting bracket is a U-shaped member including spaced legs and an interconnecting member, and the platform means comprise spaced parts of the unitary base between which the mounting means are disposed and on which the spaced legs are mounted.

6. The switch of claim 5 in which the interconnecting member includes spaced set means, the pivot arm being in biased engagement with the set means for enabling lateral spacing of one moving contact with respect to another contact.

7. The switch of claim 6 in which the spaced set means comprise set tabs spaced oxially of the shaft.

* * * * *